United States Patent [19]

Inagaki et al.

[11] 4,408,968

[45] Oct. 11, 1983

[54] ROTARY COMPRESSOR

[75] Inventors: Mitsuo Inagaki; Hideaki Sasaya; Seitoku Ito, all of Okazaki, Japan

[73] Assignee: Nippon Soken, Inc., Nishio, Japan

[21] Appl. No.: 233,431

[22] Filed: Feb. 11, 1981

[30] Foreign Application Priority Data

Mar. 12, 1980 [JP] Japan ..... 55-31828

[51] Int. Cl.[3] ..... F03C 2/00

[52] U.S. Cl. ..... 418/15; 418/255

[58] Field of Search ..... 418/15, 255

[56] References Cited

U.S. PATENT DOCUMENTS

| | | | |
|---|---|---|---|
| 2,129,960 | 9/1938 | Presby | 418/15 |
| 3,156,410 | 11/1964 | LeRiche | 418/15 |
| 3,301,474 | 1/1967 | Buchel | 418/15 |
| 3,964,447 | 6/1976 | Normandin | 418/255 |
| 3,995,977 | 12/1976 | Takahasi et al. | 418/255 |
| 4,133,617 | 1/1979 | Reynand | 418/255 |
| 4,233,003 | 11/1980 | Jeng | 418/15 |

FOREIGN PATENT DOCUMENTS

| | | |
|---|---|---|
| 37-11725 | 8/1962 | Japan . |
| 51-22201 | 7/1976 | Japan . |

*Primary Examiner*—Henry C. Yuen

*Attorney, Agent, or Firm*—Cushman, Darby & Cushman

[57] ABSTRACT

A rotary compressor including a housing having therethrough a cylindrical bore, end plates attached to the housing to close the open axial ends of the bore respectively, an eccentric rotor rotatable in the bore and vanes slidably mounted in the rotor. A working chamber defined between the adjacent pair of vanes communicates with a discharge chamber outside of the housing through a discharge opening in the wall of the housing. First and second passages have their respective one ends opening to the cylindrical bore and the respective other ends communicating with the discharge chamber. The one end of the first passage is positioned at a location or adjacent thereto where the leading one of the adjacent pair of vanes is positioned when the working chamber defined therebetween has its volume starting to decrease. The one end of the second passage is positioned at a location where the one end of the second passage together with the discharge opening is opened to one of the discharge chambers with the latter having its volume decreased and communicating with the discharge opening. First and second check valves respectively in the passages are opened only when the working chambers respectively associated with the passages have therein pressures higher than respective predetermined values.

6 Claims, 3 Drawing Figures

ROTARY COMPRESSOR

BACKGROUND OF THE INVENTION

1. Field of the Invention

This invention relates to rotary compressors, and more particularly it is concerned with a through-vane type compressor, such as the one disclosed in Japanese Patent Publication No. 22201/76, suitable for use with a refrigerant compressor of an air conditioning system.

2. Description of the Prior Art

In a rotary compressor for use in compressing a refrigerant, the refrigerant contained in the working chambers of the compressor and the refrigerant supply and discharge lines tends to be condensed by the ambient temperature while the compressor is shut down, and this often leads to the refrigerant in a liquid state being stored in the working chambers and the refrigerant supply and discharge lines. Starting up of the compressor under these circumstances would result in the liquid refrigerant being compressed, and an inordinately high pressure would be produced in a working chamber in a compression stroke. Thus what is referred to as a sledging phenomenon would occur which would give rise to the problem of the vanes and the discharge valve being damaged and their service lives being shortened. To avoid this problem, proposals have been made to provide the compressor with a check valve mounted on an end plate attached to the housing which is adapted to be actuated when the pressure in the working chambers rises to an inordinately high level, as disclosed in Japanese Patent Publication No. 11725/62.

In case the compressor is suddenly started when a large volume of liquid is contained in a working chamber or the ambient temperature is relatively low, the sledging phenomenon would occur on a large scale, and an ordinary relief valve could not function satisfactorily as the check valve for avoiding damage to the vanes and valve. To increase the effectiveness of the check valve, attempts have been made to increase the diameter of the valve. However, the efficiency of the compressor would be reduced if the diameter of the valve exceeds the width of the vanes because the refrigerant being compressed would be blown through the check valve. A research conducted by inventors of the present application has revealed that even if the diameter of the check valve is slightly increased it is difficult to avoid compression of liquid refrigerant at all the rotational angles during one complete revolution of each vane.

SUMMARY OF THE INVENTION

This invention has as its object the provision of a rotary compressor capable of avoiding a sledging phenomenon which might be caused by compression of liquid refrigerant at a startup.

According to the invention, there is provided a rotary compressor comprising a housing having therethrough a cylindrical bore and a discharge opening formed through the wall of the housing and communicating with the cylindrical bore; a discharge chamber disposed downstream of the discharge opening and communicating therethrough with the cylindrical bore; end plates attached to the axial ends of the housing to close the open axial ends of the cylindrical bore, respectively; a rotor rotatably disposed in the cylindrical bore and having an axis extending in an eccentric relation to the axis of the cylindrical bore; a plurality of vanes slidably mounted in the rotor, each of the vanes cooperating with the adjacent vane, the wall surface of the cylindrical bore in the housing, the outer periphery of the rotor and the end plates to define a working chamber, the working chambers having their volumes changed, during one revolution of the rotor, to compress fluid to discharge the compressed fluid through the discharge opening into the discharge chamber; first passage means having one end thereof opening to the cylindrical bore in the housing and the other end communicating with the discharge chamber, the one end of the first passage means being positioned at an area adjacent to and including a location where the leading one of the adjacent pair of vanes is positioned when the working chamber defined between the adjacent pair of vanes has its volume starting to decrease; first check valve means provided in the first passage means for allowing the working chamber associated with the first passage means to be communicated therethrough with the discharge chamber to directly introduce the fluid within the working chamber into the discharge chamber only when the associated working chamber has its volume decreased and pressure increased higher than a predetermined value; second passage means having one end thereof opening to the cylindrical bore in the housing and the other end communicating with the discharge chamber, the one end of the second passage means being positioned at a location where the one end of the second passage means together with the first discharge opening is communicated with the working chamber defined between the adjacent pair of vanes with the working chamber having its volume decreased and being communicated with the discharge opening; and second check valve means provided in the second passage means for allowing the working chamber associated with the second passage means to be communicated therethrough with the discharge chamber only when the associated working chamber has its volume decreased and pressure increased higher than a predetermined value.

DESCRIPTION OF THE PREFERRED EMBODIMENT

Figure 1:
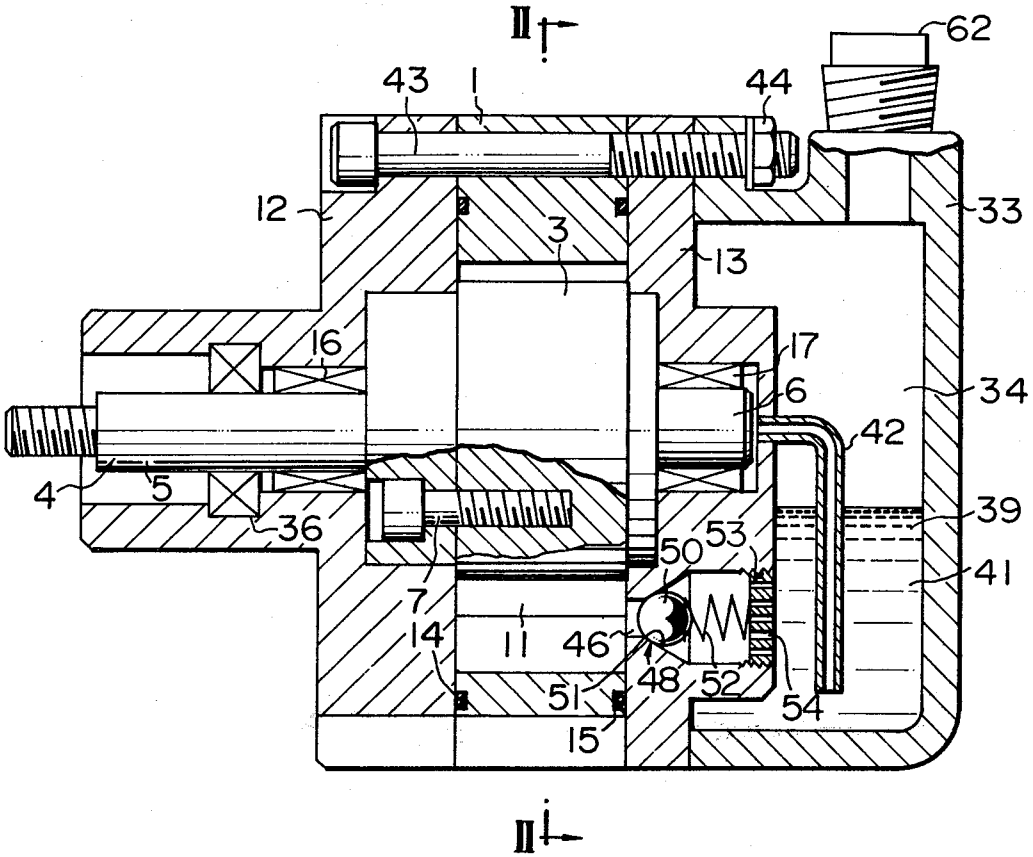
FIG. 1 is a sectional view of the rotary compressor according to the invention, taken along the line I—I in FIG. 2.
Figure 2:
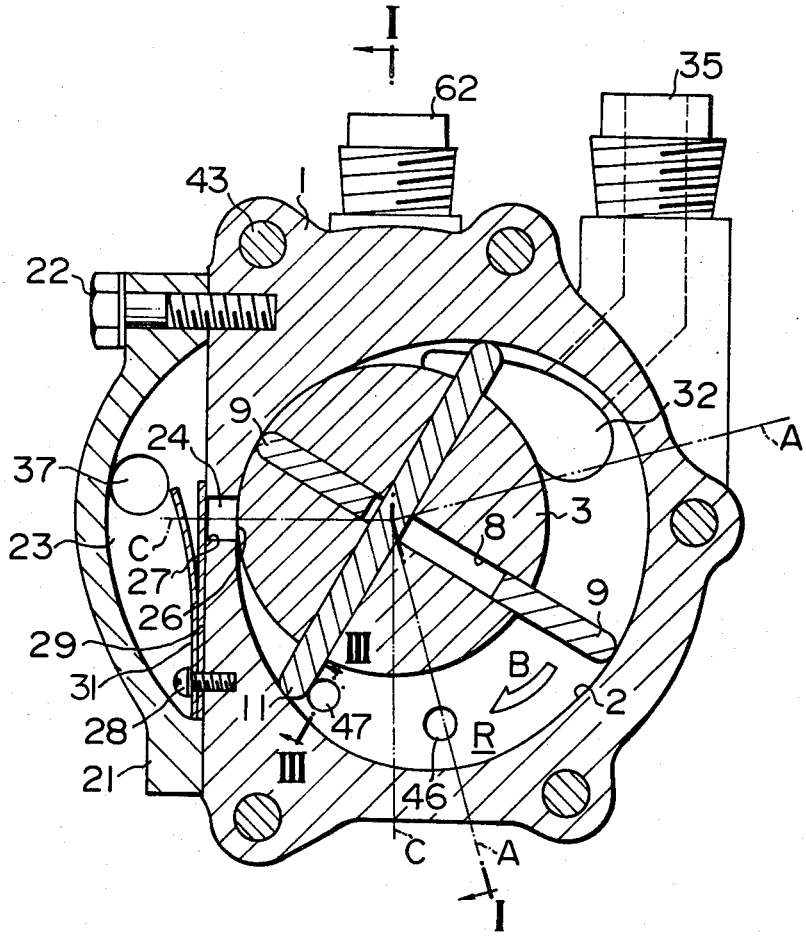
FIG. 2 is a sectional view of the rotary compressor shown in FIG. 1 taken along the line II—II in FIG. 1.
Figure 3:
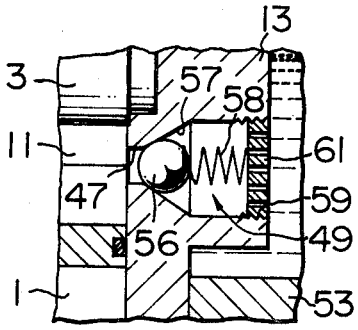
FIG. 3 is a sectional view of the rotary compressor shown in FIG. 2 taken along the line III—III in FIG. 2.

Referring to FIGS. 1-3, the rotary compressor according to the invention comprises a housing 1 formed therein with a cylindrical bore 2, and a cylindrical rotor 3 rotatably mounted in the cylindrical bore 2 in the housing 1 and having a longitudinal axis extending in eccentric relation to the longitudinal axis of the cylindrical bore 2. The rotor 3 is bolted at 7 to a rotary shaft 4 including shaft sections 5 and 6 for rotation with the rotary shaft 4 as a unit. The rotor 3 is formed with two vane grooves 8 extending through the center of the rotor 3 in such a manner that open ends of one vane groove are spaced apart from the open ends of the other vane groove an angular extent of 90°. Vanes 9 and 11 are slidably inserted in the vane grooves 8 respectively.

End plates 12 and 13 are secured through O-ring seals 14 and 15 to opposite open axial ends, respectively, of the housing 1, and the shaft sections 5 and 6 of the rotary shaft 4 are rotatably journalled by bearings 16 and 17 fitted in the end plates 12 and 13 respectively.

The vane 11 cooperates with the adjacent vane 9, end plates 12 and 13, the wall surface of the bore 2 and the outer circumferential surface of the rotor 3 to define a working chamber R. A side plate 21 is bolted at 22 to one side of the housing 1 to define a discharge chamber 23. The housing 1 is formed with a discharge port 24 extending through its wall and having two ends, one end 26 opening in one of the working chambers R and the other end 27 communicating with the discharge chamber 23 through a discharge reed valve 29 screwed at 28 to the side of the housing 1 in the discharge chamber 23. A stopper 31 bolted at 28 to the side of the housing 1 has the function of restricting the movement of the reed valve 29 away from the port 24.

The end plate 13 at the rear end of the housing 1 is formed with a suction opening 32 extending therethrough and has attached thereto an end cover 33 to define therebetween a separated suction chamber, not shown, and a discharge chamber 34. The suction opening 32 communicates, through the suction chamber, not shown, with a suction port 35 for introducing a refrigerant into the working chambers R.

A seal assembly 36 is mounted between the front end plate 12 and the front shaft section 5 of the rotary shaft 4 to avoid leakage of the lubricant or refrigerant along the shaft section 5 of the rotary shaft 4 to outside.

The discharge chamber 34 defined between the end cover 33 and the rear end plate 13 communicates with the discharge chamber 23 through a bore 37 formed in the side cover 21 and functions concurrently as an oil separator. The refrigerant discharged into the discharge chamber 23 is led through the bore 37 to the discharge chamber 34. As the refrigerant enters the discharge chamber 34, its volume is suddenly increased, so that lubricant 39 incorporated in the refrigerant is separated and collected in an oil reservoir 41 defined at the bottom of the discharge chamber 34. An oil supply conduit 42 communicates the oil reservoir 41 with an axial end face of the rear shaft section 6 of the rotary shaft 4 to draw the lubricant 39 from the oil reservoir 41 and feed the same along the outer circumferential surface of the shaft section 6 of the rotary shaft 4 to the bearing 17 and other parts requiring lubrication.

The front and rear end plates 12 and 13, housing 1 and end cover 33 are all formed of cast iron or an aluminum alloy and connected together by through bolts 43 and nuts 44.

The rear end plate 13 is formed with a first communication bore 46 at a location where the leading one of the adjacent vanes 9 and 11 is disposed when the working chamber R defined by the adjacent vanes 9 and 11 begins to have its volume reduced. Stated differently, the first communication bore 46 is positioned such that when the adjacent vanes 9 and 11 are disposed on dash-and-dot lines A shown in FIG. 1 and the volume of the working chamber R defined therebetween is maximized, the bore 46 is communicated with the working chamber R of the maximized volume. The rear end plate 13 is also formed with a second communication port 47 at a location where the bore 47 is communicated with the working chamber R of the reduced volume defined by the adjacent vanes 9 and 11 when the working chamber R of the reduced volume is communicated with the discharge port 24. Stated differently, the second communication bore 47 is positioned such that it is still communicated with the working chamber R of the reduced volume even if the adjacent vanes 9 and 11 are disposed on dash-and-dot lines C shown in FIG. 2 following rotation of the rotor 3 in the direction of an arrow B and the leading one of the vanes 9 and 11 is aligned with the discharge port 24.

The first and second communication ports 46 and 47 both keep the working chamber R in communication with the oil reservoir 41 at the bottom of the discharge chamber 34 defined between the end cover 33 and the rear end plate 13. The first and second communication ports 46 and 47 have mounted therein check valve assemblies 48 and 49 respectively operative to open the ports 46 and 47 only when the pressure in the working chamber R has risen over predetermined value (between 1 and 5 atmospheric pressures, for example, and preferably about 1 atmospheric pressure) above the pressure in the discharge chamber 34, to let the refrigerant in the working chamber R escape to the discharge chamber 34.

The check valve assembly 48 comprises a valve body 50 formed of steel in spherical form positioned against a tapering surface 51 of the first communication port 46, a spring 52 urging by its biasing force the valve body 50 to move in a direction in which the port 46 is closed, and a retaining member 54 connected to one end of the spring 52 and threadably engaging an internally threaded surface 53 of the bore 46. The retaining member 54 can be moved leftwardly and rightwardly in FIG. 1 to thereby adjust the load applied to the spring 52.

Referring to FIG. 3, the check valve assembly 49 comprises a valve body 56 formed of steel in spherical form positioned against a tapering surface 57 of the second communication port 47, a spring 58 urging by its biasing force the valve body 56 to move in a direction in which the port 47 is closed, and a retaining member 61 connected to one end of the spring 58 and threadably engaging an internally threaded surface 59 of the bore 47. The retaining member 51 can be moved rightwardly and leftwardly in the figure to thereby adjust the load applied to the spring 58.

The operation of the compressor of the aforesaid constructional form will be described. The rotary shaft 4 is rotated by motive force transmitted from a power source, such as an automotive vehicle engine, not shown, to thereby rotate the rotor 3 and vanes 9 and 11 to cause changes to occur in the volumes of the working chambers R. At a time when the volume of one of the working chambers R increases, the refrigerant in a gaseous state introduced from the refrigeration cycle, not shown, into the suction port 35 and the suction chamber, not shown, defined by the end cover 33 is drawn into the working chamber R through the suction opening 32. The gaseous refrigerant thus introduced into the working chamber R is cut off the suction opening 32 as the rotor 3 rotates (as the working chamber R is in the position defined by the dash-and-dot line position A in FIG. 2). The gaseous refrigerant is compressed as the volume of the working chamber R is reduced with further rotation of the rotor 3 until the volume is minimized, when the working chamber R is communicated with the discharge port 24, so that the compressed gaseous refrigerant is discharged into the discharge chamber 23.

The gaseous refrigerant discharged into the discharge chamber 23 is discharged through the bore 37 formed in the side cover 21 into the discharge chamber 34 serving concurrently as an oil separator. That is, as the compressed gaseous refrigerant flows out of the bore 37 into the discharge chamber, the flow thereof is suddenly increased to thereby separate the lubricant from the refrigerant. After having the lubricant separated therefrom, the refrigerant is discharged from the discharge chamber 34 through an outlet port 62 opening in an upper portion of the end cover 33 into a condenser of the refrigeration cycle, not shown.

Since the discharge chamber 34 has a high internal pressure due to the pressure of the compressed gaseous refrigerant introduced thereinto, the lubricant 39 collected in the oil reservoir 41 after being separated from the refrigerant flows upwardly through the oil supply conduit 42 to be fed along the outer circumferential surface of the rear shaft section 6 of the rotary shaft 4 to the bearing 17 and other parts requiring lubrication.

Generally, in a rotary compressor, the refrigerant in the working chambers R and refrigerant supply and discharge lines tends to be condensed into a liquid state when the compressor is shut down over a prolonged period of time. In case the compressor is disposed at a lower level than other equipment constituting the refrigeration cycle in particular, a refrigerant in a liquid state is collected in large amounts in the working chambers R. In the event that the compressor is started while in this condition, the refrigerant in a liquid state collected in the working chambers R and the refrigerant in a liquid state fed through the suction opening 32 into the working chamber R would be sealed in the working chambers R. Thus there is the risk that when the compressor is actuated the liquid refrigerant is compressed, so that a pressure of inordinately high level is produced instantly.

The compressor of the aforesaid constructional form is capable of avoiding this phenomenon. More specifically, the first and second communication ports 46 and 47 formed in the rear end plate 13 are opened when the pressure in the working chambers R rises above a predetermined level at the time of compressor startup because the check valve assemblies 48 and 49 are brought to an open position. Thus the liquid refrigerant is released from the working chambers R through the discharge chamber 34 before the internal pressure of the working chambers R rises to an inordinately high level.

As the vanes 9 and 11 are positioned as indicated by dash-and-dot lines in FIG. 2 and the volume of the working chamber R begins to decrease, the first communication port 46 is opened to bring the working chamber R into communication with the discharge chamber 34. At initial stages of initiation of compression when the working chamber R is in the position of the dash-and-dot lines, a reduction in the volume thereof is not so great. Therefore, as the volume of the working chamber R is successively reduced, the liquid refrigerant has its pressure increased with a reduction in the volume of the working chamber R to a sufficiently high level to be released from the working chamber R through the first communication port 46 alone.

However, when the rotor 3 further rotates to bring the vanes 9 and 11 to a position indicated by solid lines in FIG. 2, the volume of the working chamber R undergoes quite a sudden reduction, so that it becomes difficult for the first communication port 46 alone to release all the liquid refrigerant into the discharge chamber 34. When further rotation of the rotor 3 brings the vanes 9 and 11 to the solid line position in FIG. 2, the second communication port 47 is also opened, so that the working chamber R communicates with the discharge chamber 34 through both the first and second communication ports 46 and 47. This is conducive to prevention of the pressure in the working chamber R from becoming inordinately high.

Further rotation of the rotor 3 brings the vanes 9 and 11 to a position indicated by dash-and-dot lines C in FIG. 2 in which the working chamber R is brought out of communication with the first communication port 46 and into communication with the discharge port 24. The discharge port 24 communicates the working chamber R with outside, like the communication ports 46 and 47, and the diameter of the port 24 is greater than those of the ports 46 and 47, so that the discharge port 24 has the function of letting the liquid refrigerant of high pressure escape therethrough from the working chamber R. However, since the discharge port 24 is formed in the wall of the housing 2, effective use of all the area of the port 24 for releasing the liquid refrigerant is prevented by the fact that one end 26 thereof is partly blocked by the rotor 3. Thus, after the first communication port 46 is cut off the working chamber R, it would be difficult to release the liquid refrigerant through the discharge port 24 alone, and the discharge valve 29 would be damaged if the liquid refrigerant is allowed to flow through the discharge port 24 alone. Means is provided by the invention to obviate this disadvantage. That is, even if the discharge port 24 communicates with the working chamber R in place of the first communication port 46, the second communication port 47 remains in communication with the working chamber R for a while, to allow the liquid refrigerant to escape from the working chamber R through both the second communication port 47 and the discharge port 24. Thus a rise of the internal pressure of the working chamber to an inordinately high level can be avoided.

From the foregoing, it will be appreciated that according to the invention, the majority of the liquid refrigerant in the working chamber R is released to the discharge chamber 34 before the working chamber R communicates with outside only through the discharge port 24, thereby preventing the discharge valve 29 from suffering damage.

The first and second communication ports 46 and 47 of the compressor according to the invention communicate the working chamber R with the oil reservoir 41 in the discharge chamber 34. During normal compression operation, the pressure in the oil reservoir 41 is under the influence of the pressure of the refrigerant discharged into the discharge chamber 34 and rise to a considerably high level. Thus the check valve assemblies 48 and 49 are urged to close the communication ports 46 and 47 respectively by the biasing forces of the springs 52 and 58 plus the pressure differential between the discharge chamber 34 and the working chamber R. As a result, the check valve assemblies 48 and 49 may be small in size and low in cost to effectively block the communication ports 46 and 47 during normal compression operation.

The liquid refrigerant discharged through the communication ports 46 and 47 at compressor startup is collected in the oil reservoir 41, so that only the refrigerant changed into a gaseous state in an upper portion of the discharge chamber 34 is led to the condenser, thereby having no effects on the refrigeration cycle.

The provision of the check valve assemblies 48 and 49 in the rear end plate 13 permits an increase in the overall dimension of the compressor to be avoided.

In the embodiments shown and described hereinabove, the first and second communication ports 46 and 47 have been described as being formed in the rear end plate 13. However, in a compressor formed with a refrigerant passage outwardly of the front end plate 12 for the refrigerant discharged through the discharge port 24, the first and second communication passages 46 and 47 may be formed in the front end plate 12 to communicate the refrigerant passage with the working chamber R.

In the embodiments shown and described hereinabove, the first communication port 46 is positioned in a location in which it brings the working chamber R into communication with the discharge chamber 34 as soon as the volume of the working chamber R begins to decrease. It is to be understood, however, that the invention is not limited to this specific location of the first communication port 46, and that the same effect can be achieved even if the location in which the first communication port 46 is positioned is slightly displaced in such a manner that the leading one of the pair of vanes 9 and 11 defining the working chamber R is displaced in the direction of rotation of the rotor 3 when the volume of the working chamber R begins to decrease. A research conducted by inventors of the present application has revealed that the same result can be achieved even if the location of the leading one of the adjacent vanes 9 and 11 defining the working chamber R is displaced through a circumferential extent of about 10° in the direction B of rotation of the rotor 3 when the volume of the working chamber R is maximized.

Conversely, even if the location of the first communication port 46 is displaced in a direction opposite to the direction B of rotation of the rotor 3, no adverse effects are exerted on the performance of the compressor. Therefore, the first communication port 46 may be slightly displaced if necessary.

Likewise, the second communication port 47 may also be displaced slightly from the location shown in FIG. 2 so long as it is positioned such that it communicates with the working chamber R for a while after the discharge port 24 is brought into communication with the working chamber R.

In addition, although the two communication ports 46 and 47 are described as being formed, the number of the communication ports may be increased. Release of the liquid refrigerant from the working chamber R is facilitated by an increase in the number of the communication ports.

From the foregoing, it will be appreciated that according to the invention, communication ports are formed at least in two locations in the rear end plate 13, one communication port 46 being positioned at a location where the leading one of the adjacent vanes 9 and 11 defining a working chamber is positioned when the volume of the working chamber begins to decrease or in the vicinity of such location, and the other communication port communicates with the working chamber simultaneously as the discharge chamber communicates therewith when the discharge port is first brought into communication with the working chamber. Thus the two communication ports communicates the working chamber with the discharge chamber disposed downstream of the discharge port, and the check valves mounted in the communication ports are adapted to open the communication ports only when the pressure in the working chamber rises to a level above the predetermined pressure level. By this arrangement, the sledging phenomenon which might otherwise occur when the liquid refrigerant is compressed at compressor startup can be avoided, to thereby prevent damage to the vanes and the discharge valve.

What we claim is:

1. A rotary refrigerant compressor comprising:

a housing having therethrough a cylindrical bore and a discharge opening formed through the wall of said housing and communicating with said cylindrical bore;

a discharge chamber disposed downstream of said discharge opening and communicating therethrough with said cylindrical bore;

end plates attached to the axial ends of said housing to close the open axial ends of said cylindrical bore, respectively;

a rotor rotatably disposed in said cylindrical bore and having an axis extending in an eccentric relation to the axis of said cylindrical bore;

a plurality of vanes slidably mounted in said rotor, each of said vanes cooperating with the adjacent vane, the wall surface of said cylindrical bore in said housing, the outer periphery of said rotor and said end plates to define a working chamber, said working chambers having their volume changed, during one revolution of said rotor, to compress fluid to discharge the compressed fluid through said discharge opening into said discharge chamber;

first passage means having one end thereof opening to said cylindrical bore in said housing and the other end communicating with said discharge chamber, said one end of said first passage means being positioned at an area adjacent to and including a location where the leading one of the adjacent pair of vanes is positioned when the working chamber defined between the adjacent pair of vanes has its volume starting to decrease;

first check valve means provided in said first passage means for allowing the working chamber associated said first passage means to be communicated therethrough with said discharge chamber to directly introduce the fluid within the working chamber into said discharge chamber only when the associated working chamber has its volume decreased and pressure increased higher than normal discharge pressure in order to avoid damage due to the presence of liquid refrigerant in said working chamber;

second passage means having one end thereof opening to said cylindrical bore in said housing and the other end communicating with said discharge chamber, said one end of said second passage means being positioned at a location where said one end of said second passage means together with said discharge opening is communicated with the working chamber defined between the adjacent pair of vanes with the working chamber having its volume decreased and being communicated with said discharge opening; and second check valve means provided in said second passage means for allowing the working chamber associated with said second passage means to be communicated therethrough with said discharge chamber only when the associated working chamber has its volume decreased and pressure increased higher than a predetermined value in order to avoid damage due to the presence of a liquid refrigerant in said working chamber, the passage of which through said discharge opening is so restricted as to cause a pressure rise in said working chamber.

2. A rotary compressor defined in claim 1, wherein each of said first and second passage means comprises a bore formed through one of said end plates.

3. A rotary compressor defined in claim 2, wherein each of said first and second check valve means comprises a ball valve element disposed in each of said bores of said first and second passage means, and a spring for normally biasing said ball valve element for closing each of said bores.

4. A rotary compressor defined in claim 3, further comprising an end cover attached to said one end plate for cooperating therewith to define said discharge chamber, said discharge chamber functioning as an oil separator.

5. A rotary compressor defined in claim 1, 2, 3 or 4, wherein a diametrically opposed single pair of vanes of said plurality of vanes have radially inner ends connected to each other in an integral manner and radially outer ends slidingly engaging with the wall surface of said cylindrical bore in said housing always during the rotation of said rotor.

6. The compressor defined in claim 1 wherein the refrigerant contains oil and including:

a cover attached to one of the end plates to define therebetween an oil separator chamber, said oil separator chamber communicating with said discharge chamber for separating the lubricating oil from the refrigerant introduced into said oil separator chamber from said discharge chamber, the first and second passage means being formed in said one end plate and communicating directly with said oil separator chamber.

* * * * *